US009190783B2

(12) United States Patent
Chang

(10) Patent No.: US 9,190,783 B2
(45) Date of Patent: Nov. 17, 2015

(54) HDMI CONNECTOR

(71) Applicant: Nai-Chien Chang, New Taipei (TW)

(72) Inventor: Nai-Chien Chang, New Taipei (TW)

( * ) Notice: Subject to any disclaimer, the term of this patent is extended or adjusted under 35 U.S.C. 154(b) by 116 days.

(21) Appl. No.: 13/935,946

(22) Filed: Jul. 5, 2013

(65) Prior Publication Data

US 2014/0030914 A1 Jan. 30, 2014

(30) Foreign Application Priority Data

| | | |
|---|---|---|
| Jul. 24, 2012 | (TW) | 101214270 A |
| Aug. 28, 2012 | (TW) | 101216559 A |
| Aug. 28, 2012 | (TW) | 101216561 A |
| Aug. 28, 2012 | (TW) | 101216563 A |

(51) Int. Cl.

| | |
|---|---|
| ***H01R 13/648*** | (2006.01) |
| ***H01R 13/73*** | (2006.01) |
| ***H01R 12/70*** | (2011.01) |
| ***H01R 13/6594*** | (2011.01) |
| ***H01R 24/60*** | (2011.01) |
| *H01R 12/72* | (2011.01) |
| *H01R 13/6582* | (2011.01) |

(52) U.S. Cl.

CPC ..... *H01R 13/73* (2013.01); *H01R 12/7052* (2013.01); *H01R 13/6594* (2013.01); *H01R 24/60* (2013.01); *H01R 12/724* (2013.01); *H01R 13/6582* (2013.01)

(58) Field of Classification Search

CPC ..... H01R 23/6873
USPC ..... 439/607.35, 607.4
See application file for complete search history.

(56) References Cited

U.S. PATENT DOCUMENTS

| | | | | |
|---|---|---|---|---|
| 7,645,165 | B2 * | 1/2010 | Wu et al. | 439/607.38 |
| 8,535,097 | B2 * | 9/2013 | Yen et al. | 439/607.27 |

* cited by examiner

*Primary Examiner* — Phuong Dinh
(74) *Attorney, Agent, or Firm* — Chun-Ming Shih; HDLS IPR Services

(57) ABSTRACT

A high definition multimedia interface (HDMI) connector includes a HDMI socket (1*b*) and at least one pair positioning legs (2*b*). The HDMI socket (1*b*) has a shielding frame (11*b*). Each of the positioning legs (2*b*) is connected to the HDMI socket (1*b*) and exposed to the shielding frame (11*b*). The distance between the positioning legs (2*b*) is complied with the Display Port specification Thus, the HDMI socket (1*b*) has the positioning legs (2*b*) complied with the Display Port specification such that the HDMI socket (1*b*) can be insertedly disposed on the PCB (100*b*) having the Display Port connection to enhance assembling convenience.

17 Claims, 12 Drawing Sheets

HDMI CONNECTOR

BACKGROUND OF THE INVENTION

1. Field of the Invention

The present invention relates to a connector and in particular to an HDMI (High Definition Multimedia Interface) connector.

2. Description of Related Art

Due to the demand for high bandwidth data transmission in recent years, a Display Port with high bandwidth data transmission is considered a successor of digital video transmission. The Display Port not only uses fewer lines for high transmission bandwidth but also achieves a certain requirement of transmission bandwidth, which is nearly a the standard specification of current digital video transmission. Another digital video transmission interface used in the consumer electronics field is HDMI which similarly has the interface of high transmission bandwidth and further has the transmission function of digital data protection and simultaneous audio/video signals. Therefore, HDMI and the above Display Port have become the main streams of high definition digital transmission.

However, Display Port and HDMI are different transmission protocols, which are applicable to different fields. Accordingly, the conventional assembling of them with the PCB uses connections of two different specifications. Nevertheless, the disposition of individual installations leads to an increase in the motherboard size; thus, a motherboard with a combined connection is available in the market to allow the user to select Display Port of HDMI for installation. Consequently, an improved HDMI connector will be developed by the industry to be used in conduction with the above motherboard.

In view of this, the inventor pays special attention to research with the application of related theory and tries to overcome the above disadvantages regarding the above related art, which becomes the goal of the inventor's improvement.

SUMMARY OF THE INVENTION

One objective of the present invention is to provide an HDMI connector which uses a HDMI socket having positioning legs complied with the Display Port specification such that the HDMI socket can be insertedly disposed on the PCB having the Display Port connection, further enhancing assembling convenience.

To achieve the above objective, the present invention provides an HDMI connector comprising an HDMI socket having a shielding frame; and two pairs of positioning legs connected to the HDMI socket and each of the two pairs of positioning legs exposed on each side of the shielding frame, respectively, in which a distance between two positioning legs on the same side of the shielding frame ranges from 6.3 mm to 8.3 mm.

To achieve the above objective, the present invention provides an HDMI connector comprising an HDMI socket having a shielding frame; and a pair of positioning legs connected to the HDMI socket and exposed on each side of the shielding frame, respectively, in which the pair of positioning legs are disposed asymmetrically and form a shift distance in between which is at least greater than 0.1 mm.

To achieve the above objective, the present invention provides an HDMI connector comprising an HDMI socket having a shielding frame; and at least one pair of positioning legs connected to the HDMI socket and each of the at least one pair of positioning legs exposed on each side of the shielding frame, in which a distance between two positioning legs of the at least one pair of positioning legs ranges from 16.1 mm to 17.9 mm.

The present invention has the following advantages.

First, used in conjunction with the PCB having the Display Port connection, the HDMI socket of the present invention uses the positioning legs complied with the Display Port specification such that the HDMI socket can be insertedly disposed on the PCB having the Display Port connection. Besides, The PCB can deal with the HDMI transmission via the Display Port connection and the chip electrically connected thereon to enhance convenience and diversity of motherboard assembling.

Second, the 19 electrically conductive terminals and the vertical fixing post are correspondingly connected to the Display Port connection, further increasing the stability of the inserting connection between the HDMI socket and the Display Port connection and then enhancing the stability of the transmission between the HDMI connector of the present invention and the PCB.

Third, two elastic pieces are formed on the surface of the shielding frame and the distance between the two elastic pieces is greater than 7.5 mm, which allows a magnetic chuck to suck the HDMI connector between the two elastic pieces during its machining and facilitates the following processes.

Fourth, the asymmetrical disposition of two positioning legs of the HDMI socket and the resulting shift distance at least greater than 0.1 mm form a foolproof mechanism to avoid incorrect inserting connection between the positioning legs and the positioning holes, which causes communication failure between the HDMI socket and the PCB. Thus, the present invention ensures more secure assembling of the HDMI connector and the PCB, further saving the labor and time of assembling.

DETAILED DESCRIPTION OF THE INVENTION

The detailed explanation and technique of the present invention will be described with figures as follows. However, the accompanying figures are only for reference and explanation, not to limit the scope of the present invention.

Figure 1:
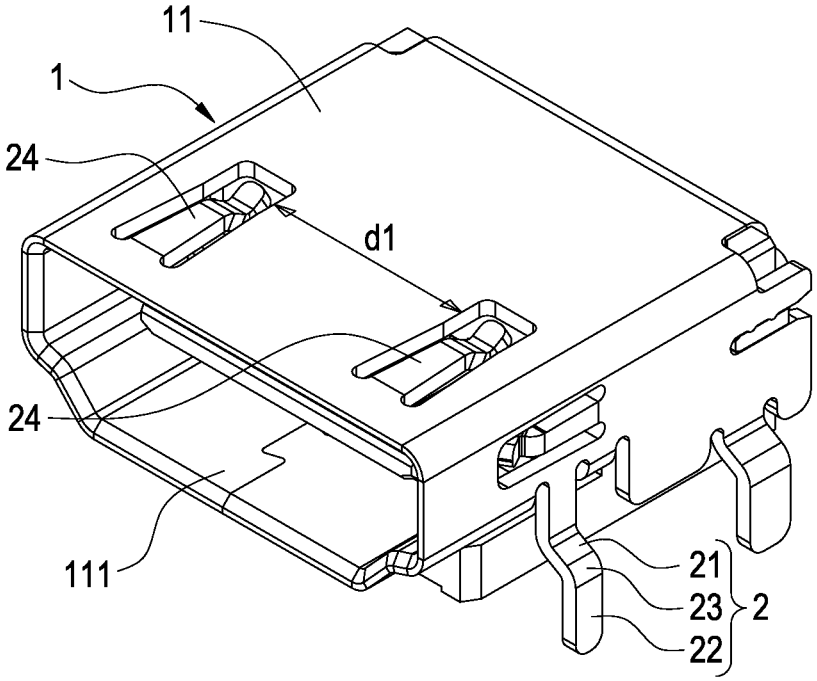
FIG. 1 is a perspective schematic of the HDMI connector according to the first embodiment of the present invention.
Figure 2:
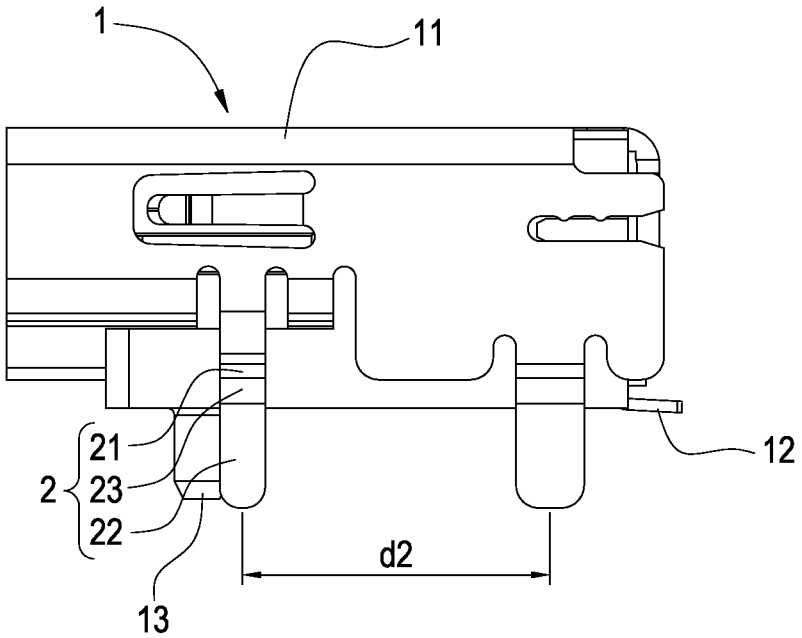
FIG. 2 is a side schematic view of the HDMI connector according to the first embodiment of the present invention.
Figure 3:
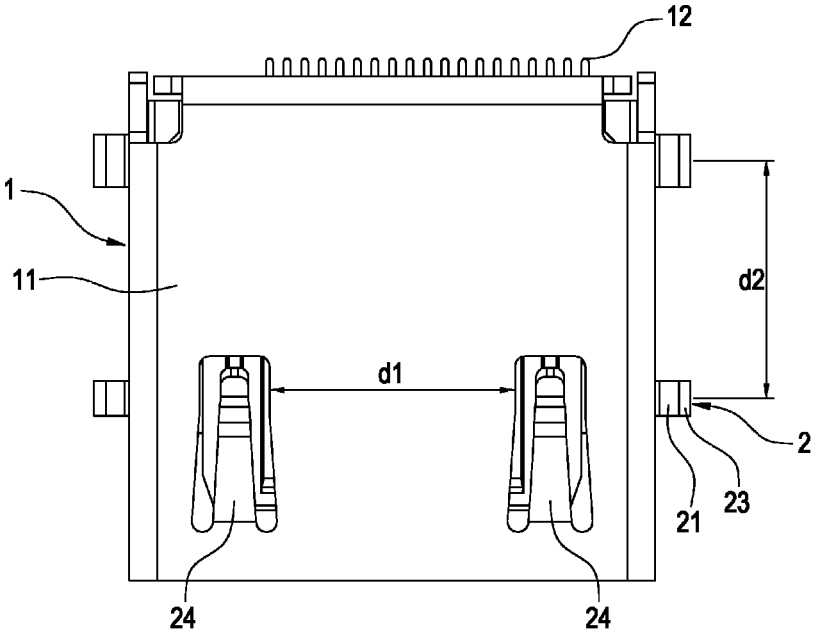
FIG. 3 is a top schematic view of the HDMI connector according to the first embodiment of the present invention.
Figure 4:
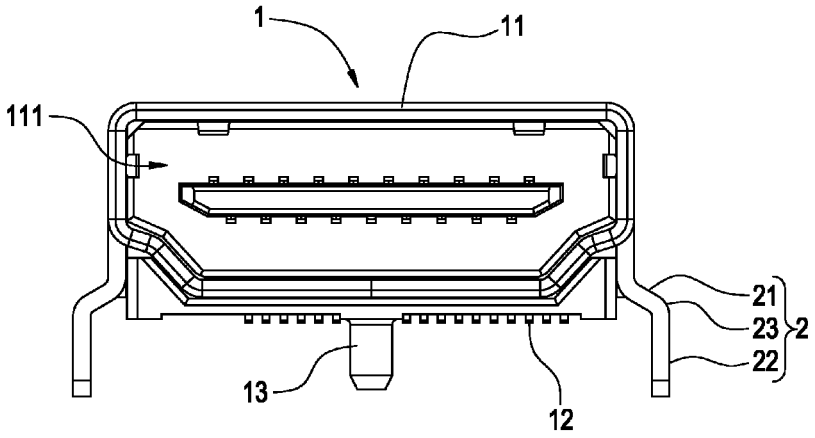
FIG. 4 is a front schematic view of the HDMI connector according to the first embodiment of the present invention.
Figure 5:
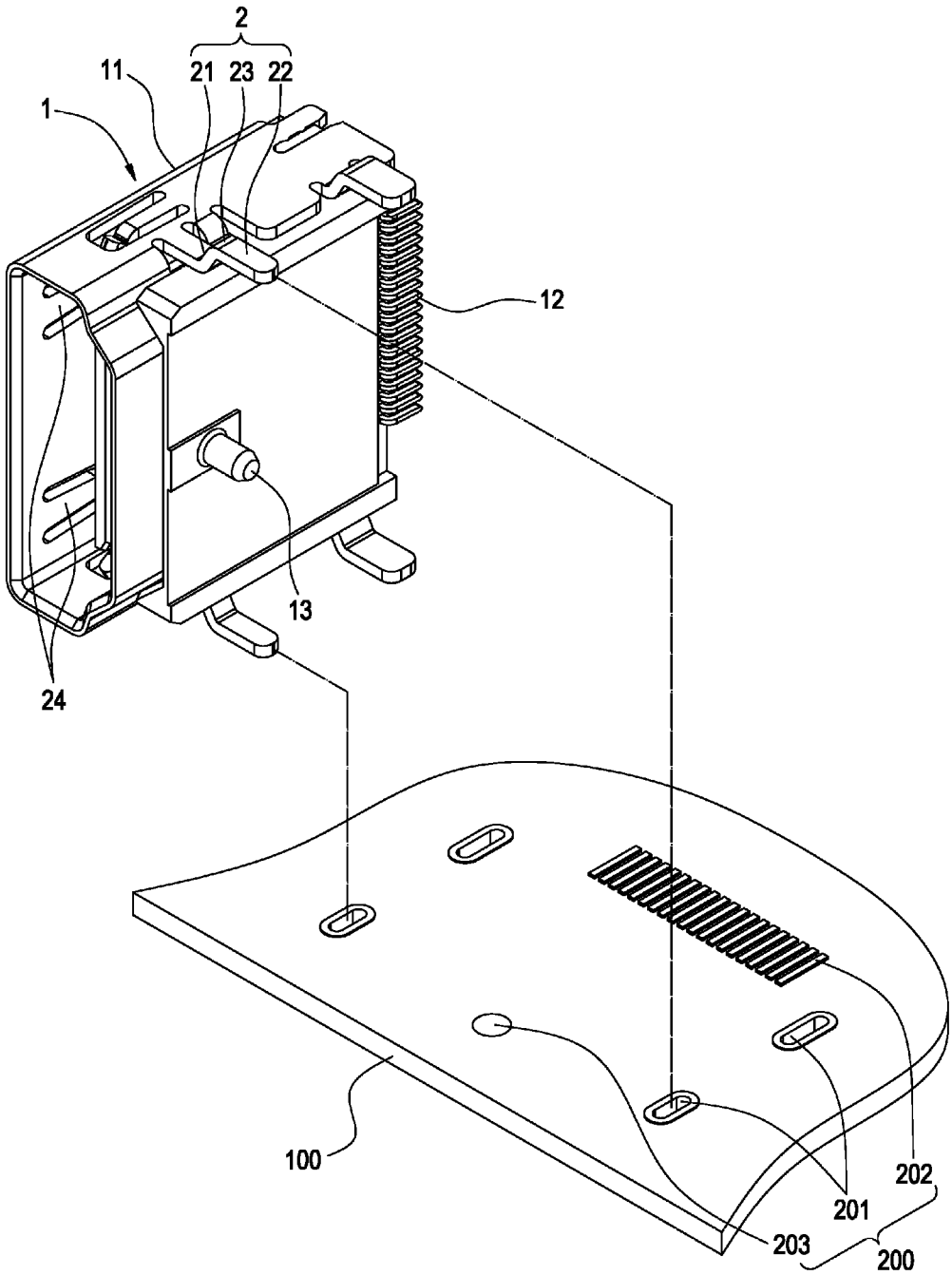
FIG. 5 is a schematic view of the HDMI connector according to the first embodiment of the present invention in an operational state.
Figure 6:
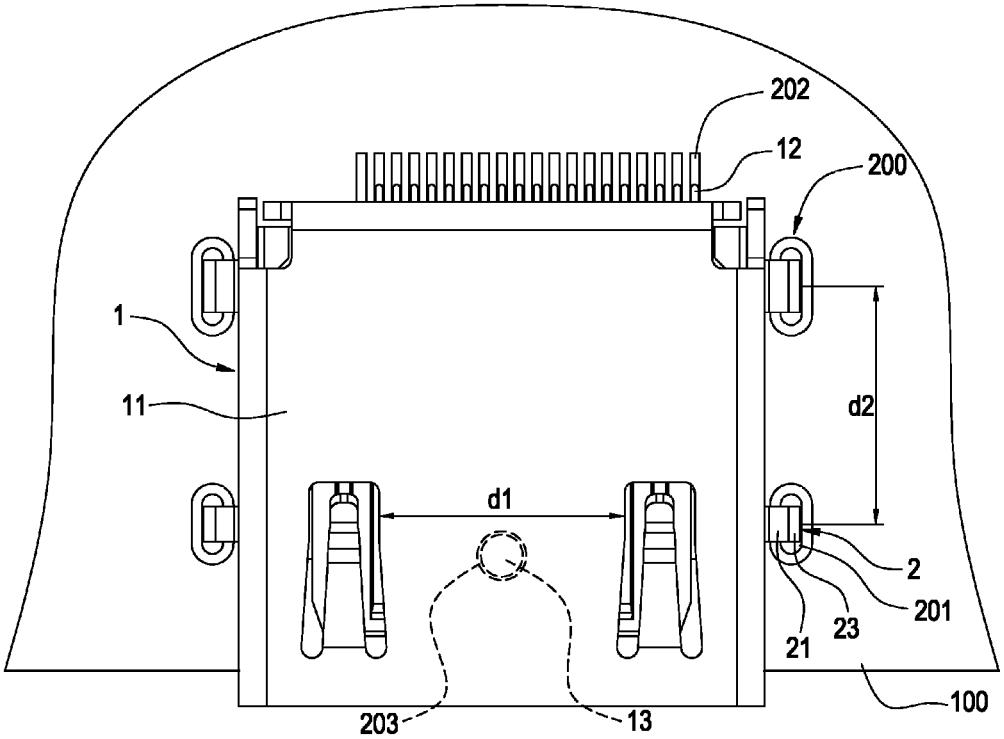
FIG. 6 is a schematic view of the HDMI connector according to the first embodiment of the present invention in another operational state.
Figure 7:
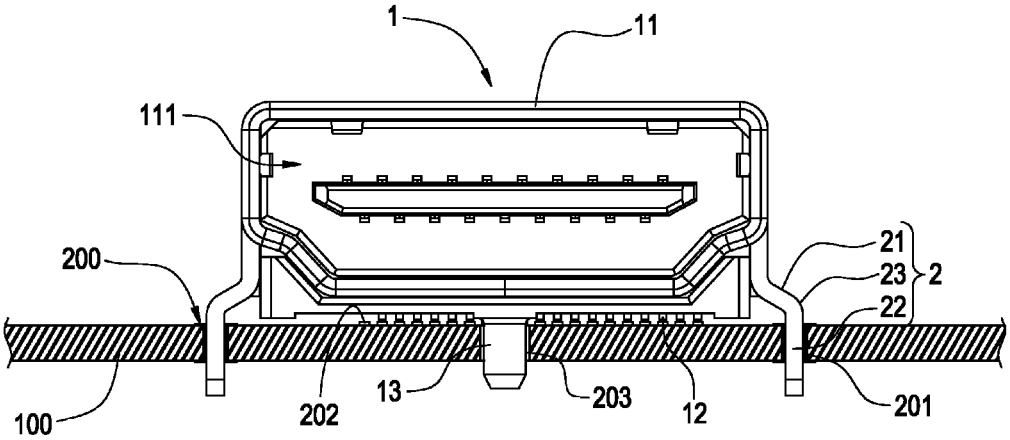
FIG. 7 is a schematic view of the HDMI connector according to the first embodiment of the present invention in yet another operational state.

Please refer to FIGS. 1-7 which relate to an HDMI connector of the present invention. The HDMI connector mainly comprises an HDMI socket 1 and two pairs of positioning legs 2.

The HDMI socket 1 has a shielding frame 11 which is hollow frame body. The HDMI socket 1 forms an inserting opening 111 corresponding to the shielding frame 11. Besides, the HDMI socket 1 has 19 electrically conductive terminals 12 exposed to the shielding frame 11 and disposed in parallel, in which the 19 electrically conductive terminals 12 are opposite to the inserting opening 111 at the front end of the shielding frame 11 and disposed on the rear right of the shielding frame 11. Moreover, the HDMI socket 1 has a vertical fixing post 13 exposed to the shielding frame 11. In addition, two elastic pieces 24 are formed on the surface of the shielding frame 11 far away from the positioning legs 2, in which the distance d1 between the two elastic pieces 24 is greater than 7.5 mm.

Each pair of positioning legs 2 are connected to the HDMI socket 1 and exposed on each side of the shielding frame 11, in which the distance d2 between two positioning legs 2 on the same side of the shielding frame 11 ranges from 6.3 mm to 8.3 mm.

The detailed description is given below. Two pairs of positioning legs 2 are extending from the shielding frame 11, respectively, and formed. That is, the two pairs of positioning legs 2 are disposed at the front end and the rear end of the shielding frame 11, respectively; each pair of the positioning legs 2 are extending from the left side and the right side of the shielding frame 11, respectively, and formed. Moreover, each of the positioning legs 2 has an extending segment 21 and a connecting segment 22; a bending segment 23 is disposed between the extending segment 21 and the connecting segment 22. Two connecting segments 22 are insertedly disposed in the corresponding positioning holes 201. The distance d2 is formed between the two connecting segments 22 on the same side of the shielding frame 11.

The assembling of the HDMI connector of the present invention is performed using the HDMI socket 1 having the shielding frame 11, and each pair of positioning legs 2 connected to the HDMI socket 1 and exposed on both sides of the shielding frame 11, in which the distance d2 between the two positioning legs 2 on the same side of the shielding frame 11 ranges from 6.3 mm to 8.3 mm.

As for the operation of the HDMI connector of the present invention, the HDMI connector of the present invention is used in a PCB 100 having a Display Port connection 200. The PCB 100 deals with the transmissions of Display Port and HDMI via the Display Port connection 200 and other chips electrically connected thereto. The Display Port connection 200 includes two pairs of positioning holes 201, 20 electrically conductive portions 202, and an auxiliary fixing hole 203.

The HDMI socket 1 is connected to tow pairs of positioning legs 2. The distance d2 between the two positioning legs on the same side of the shielding frame 11 ranges from 6.3 mm to 8.3 mm, which complies with the Display Port specification; thus, the two pairs of positioning legs 2 can be correspondingly inserted into the positioning holes 201. Besides, the 19 electrically conductive terminals 12 of the HDMI socket 1 are also correspondingly electrically connected to 19 of the 20 electrically conductive portions 202. Also, the vertical fixing post 13 of the HDMI socket 1 is correspondingly inserted into the auxiliary fixing hole 203 and secured.

To conform to the PCB 100 having a Display Port connection 200, the HDMI socket 1 of the present invention has positioning legs 2 complied with the Display Port specification; that is, the distance d2 between two positioning legs 2 on the same side of the shielding frame 11 ranges from 6.3 mm to 8.3 mm, further allowing the HDMI socket 1 to be insertedly disposed on the PCB 100 having the Display Port connection 200. In addition, the PCB 100 can deal with the HDMI transmission via the Display Port connection 200 and other chips electrically connected thereto, enhancing convenience and diversity of motherboard assembling.

Figure 8:
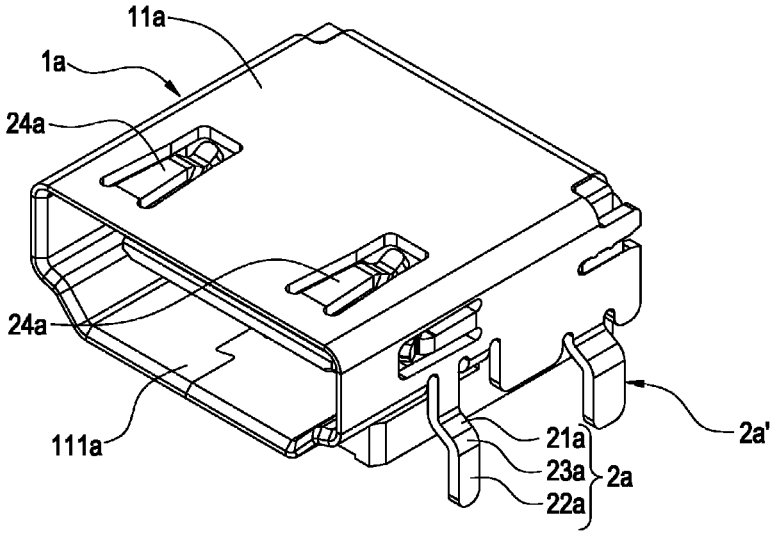
FIG. 8 is a perspective schematic of the HDMI connector according to the second embodiment of the present invention.
Figure 9:
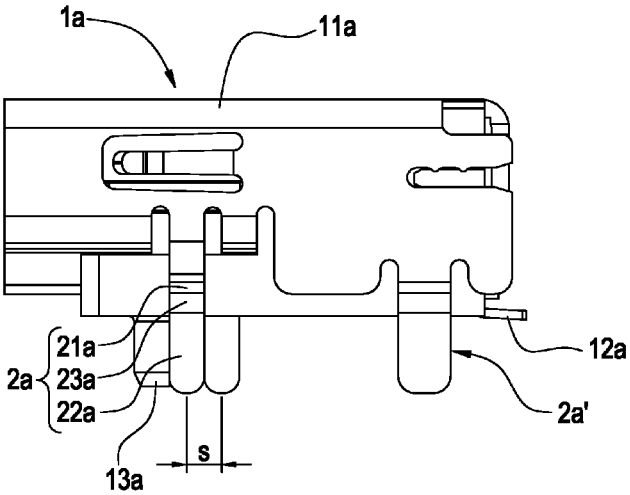
FIG. 9 is a side schematic view of the HDMI connector according to the second embodiment of the present invention.
Figure 10:
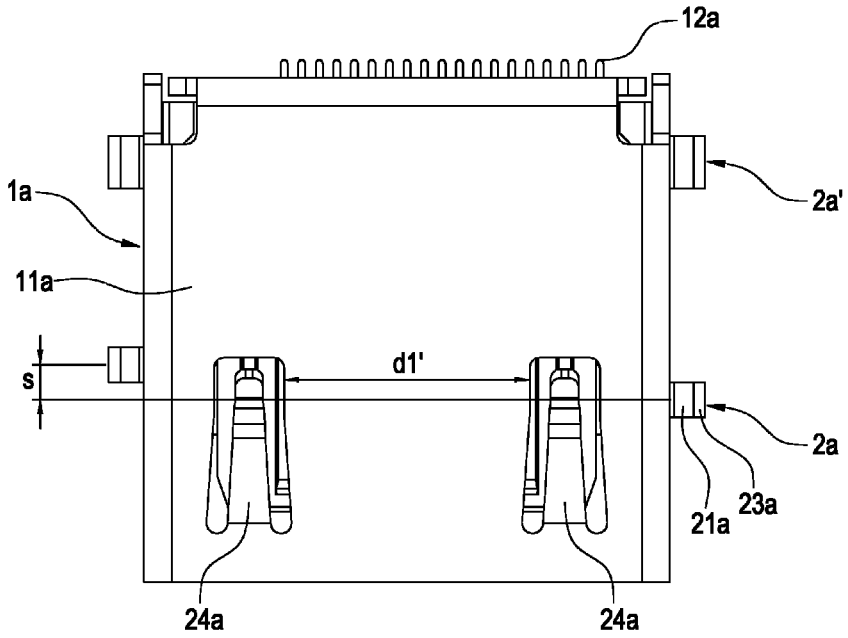
FIG. 10 is a top schematic view of the HDMI connector according to the second embodiment of the present invention.
Figure 11:
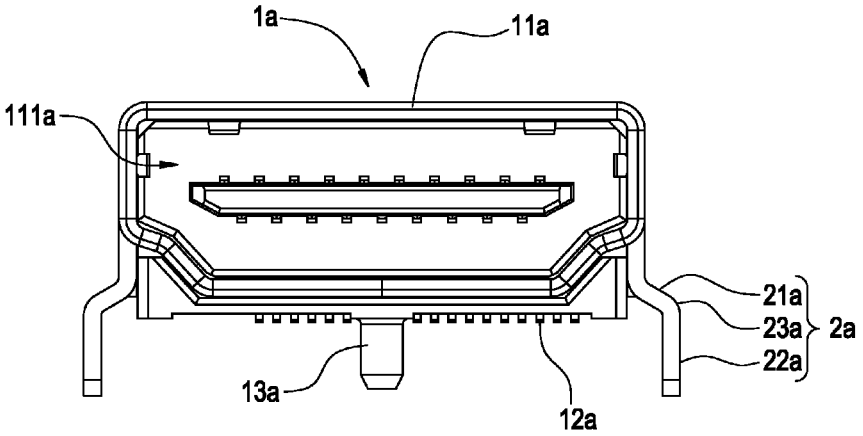
FIG. 11 is a front schematic view of the HDMI connector according to the second embodiment of the present invention.
Figure 12:
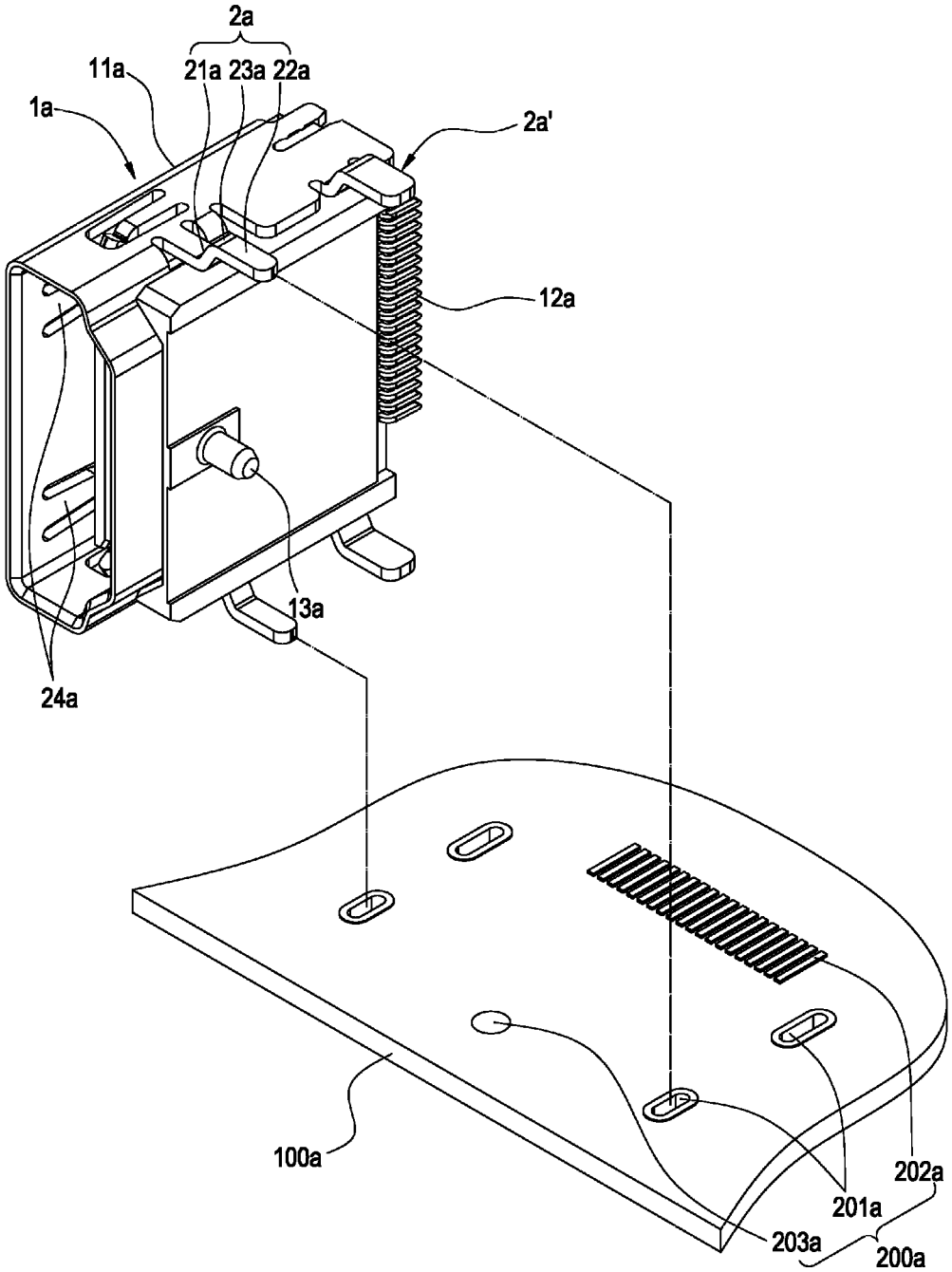
FIG. 12 is a schematic view of the HDMI connector according to the second embodiment of the present invention in an operational state.
Figure 13:
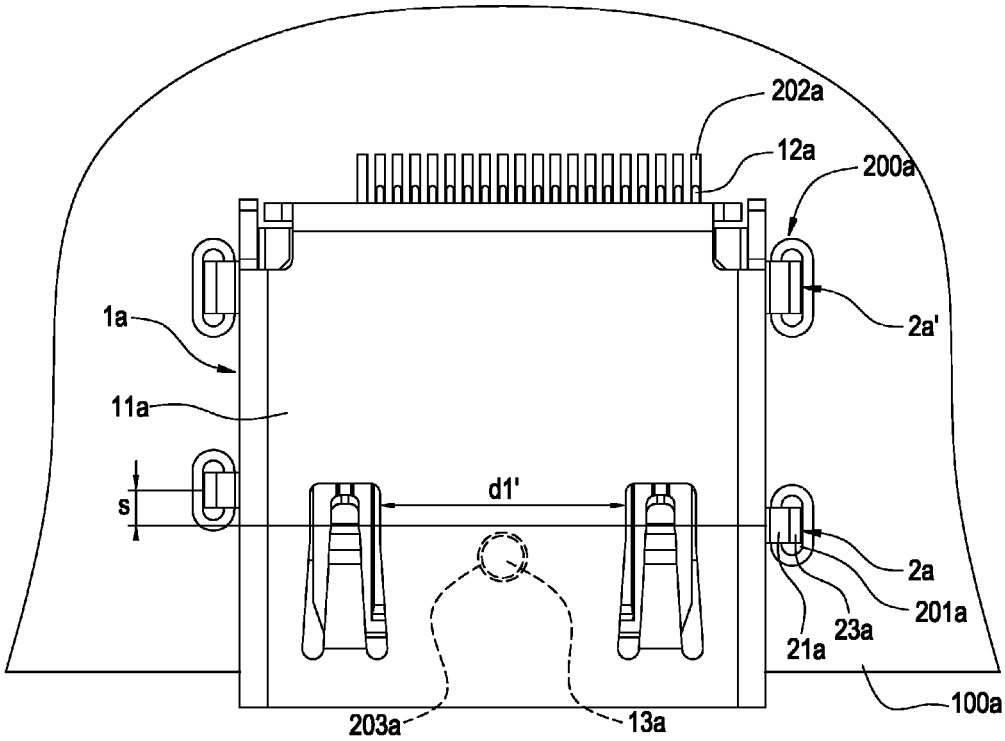
FIG. 13 is a schematic view of the HDMI connector according to the second embodiment of the present invention in another operational state.
Figure 14:
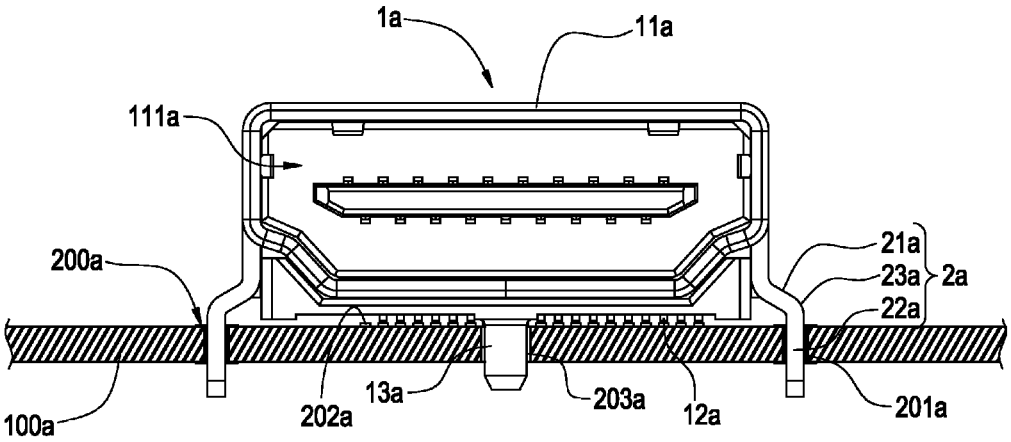
FIG. 14 is a schematic view of the HDMI connector according to the second embodiment of the present invention in yet another operational state.

Please refer to FIGS. 8-14 which relate to an HDMI connector according to the second embodiment of the present invention. This HDMI connector mainly comprises an HDMI socket 1*a* and a pair of positioning legs 2*a*.

The HDMI socket 1*a* has a shielding frame 11*a* which is hollow frame body. The HDMI socket 1*a* forms an inserting opening 111*a* corresponding to the shielding frame 11*a*. Besides, the HDMI socket 1*a* has 19 electrically conductive terminals 12*a* exposed to the shielding frame 11*a* and disposed in parallel, in which the 19 electrically conductive terminals 12*a* are opposite to the inserting opening 111*a* at the front end of the shielding frame 11*a* and disposed on the rear right of the shielding frame 11*a*. Moreover, the HDMI socket 1*a* has a vertical fixing post 13*a* exposed to the shielding frame 11*a*. In addition, two elastic pieces 24*a* are formed on the surface of the shielding frame 11*a* far away from the positioning legs 2*a*, in which the distance d1' between the two elastic pieces 24*a* is greater than 7.5 mm.

The pair of positioning legs 2*a* are connected to the HDMI socket 1*a*, respectively, and exposed on both sides of the shielding frame 11*a*. The pair of positioning legs 2*a* are disposed asymmetrically and form a shift distance s in between which is at least greater than 0.1 mm.

The detailed description is given below. The pair of positioning legs 2*a* are extending from the shielding frame 11*a*, respectively, and formed. Each positioning leg 2*a* has an extending segment 21*a* and a connecting segment 22*a*; a bending segment 23*a* is disposed between the extending segment 21*a* and the connecting segment 22*a*. Two connecting segments 22*a* are insertedly disposed in the corresponding positioning holes 201*a*. The shift distance s is formed between the two connecting segments 22*a*.

The HDMI connector of the present invention further comprises a pair of auxiliary positioning legs 2*a*'. The above-mentioned pair of positioning legs 2*a* are disposed at the front end of the shielding frame 11*a*; however, the pair of auxiliary positioning legs 2*a*' are disposed at the rear end of the shielding frame 11*a*. The above-mentioned pair of positioning legs 2*a* and the pair of auxiliary positioning legs 2*a*' are extending from both sides of the shielding frame 11*a*, respectively, and formed, in which the above-mentioned pair of positioning legs 2*a* and the pair of auxiliary positioning legs 2*a*' are the positioning legs complied with the Display Port specification. That is, the distance between the positioning leg 2*a* and the auxiliary positioning leg 2*a*' on the same side of the shielding frame 11*a* ranges from 6.3 mm to 8.3 mm. The distance between the pair of positioning legs 2*a* ranges from 16.1 mm to 17.9 mm; the distance between the pair of auxiliary positioning legs 2*a*' ranges from 16.1 mm to 17.9 mm.

The assembling of the HDMI connector of the present invention is performed using the HDMI socket 1*a* having the shielding frame 11*a*, and a pair of positioning legs 2*a* connected to the HDMI socket 1*a* and exposed on both sides of the shielding frame 11*a*. The two positioning legs 2 are disposed asymmetrically and the shift distance s between the two positioning legs 2 is at least greater than 0.1 mm.

As for the operation of the HDMI connector of the present invention, the HDMI connector of the present invention is used in a PCB 100*a* having a Display Port connection 200*a*. The PCB 100*a* deals with the transmissions of Display Port and HDMI via the Display Port connection 200*a* and other chips electrically connected thereto. The Display Port connection 200*a* includes two pairs of positioning holes 201*a*, 20 electrically conductive portions 202*a*, and an auxiliary fixing hole 203*a*.

The HDMI socket 1*a* is connected to one pair of positioning legs 2*a*. The two positioning legs 2*a* are disposed asymmetrically and from the shift distance s which is at least greater than 0.1 mm. Besides, the positioning leg 2*a* and the auxiliary positioning leg 2*a*' are complied with the Display Port specification; thus, the two pairs of positioning legs 2*a* and 2*a*' can be correspondingly inserted into the positioning holes 201*a*. Moreover, the 19 electrically conductive terminals 12*a* of the HDMI socket 1*a* are also correspondingly electrically connected to 19 of the 20 electrically conductive portions 202*a*. Further, the vertical fixing post 13*a* of the HDMI socket 1*a* is correspondingly inserted into the auxiliary fixing hole 203*a* and secured. Thus, the asymmetrical disposition of two positioning legs 2*a* of the HDMI socket 1*a* and the resulting shift distance s at least greater than 0.1 mm form a foolproof mechanism to avoid incorrect inserting connection between the positioning legs 2*a* and the positioning holes 201*a*, which causes communication failure between the HDMI socket 1*a* and the PCB 100*a*. As a result, the present invention ensures more secure assembling of the HDMI connector and the PCB, further saving the labor and time of assembling.

Also, to conform to the PCB 100*a* having a Display Port connection 200*a*, the HDMI socket 1*a* of the present invention has positioning legs 2*a* complied with the Display Port specification; that is, the positioning leg 2*a* and the auxiliary positioning leg 2*a*' are complied with the Display Port specification, further allowing the HDMI socket 1*a* to be insertedly disposed on the PCB 100*a* having the Display Port connection 200*a*. In addition, the PCB 100 can deal with the HDMI transmission via the Display Port connection 200*a* and other chips electrically connected thereto, enhancing convenience and diversity of motherboard assembling.

Figure 15:
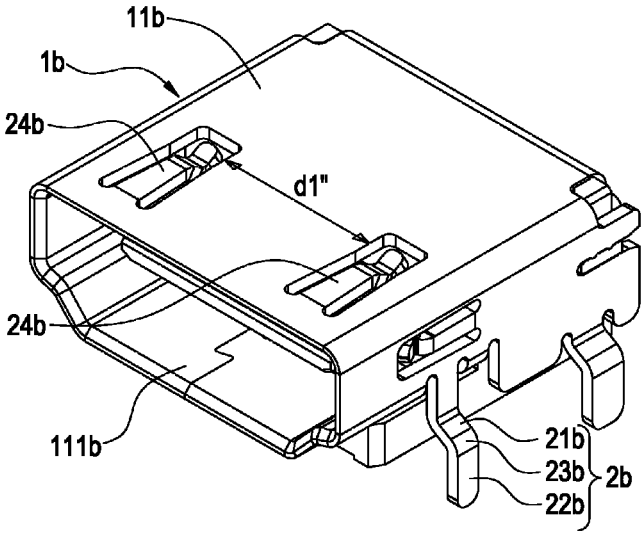
FIG. 15 is perspective schematic of the HDMI connector according to the third embodiment of the present invention.
Figure 16:
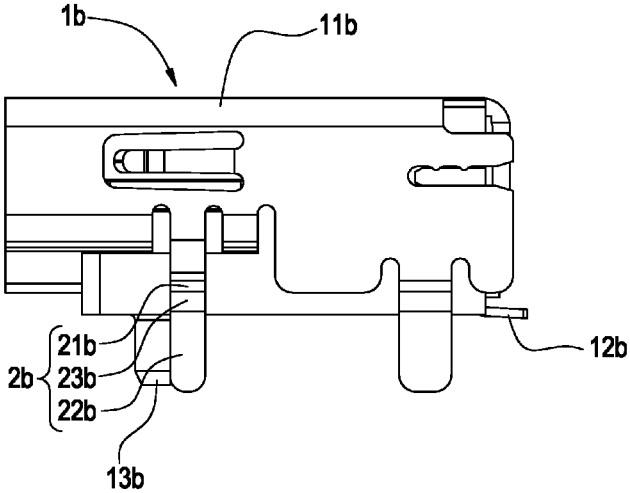
FIG. 16 is a side schematic view of the HDMI connector according to the third embodiment of the present invention.
Figure 17:
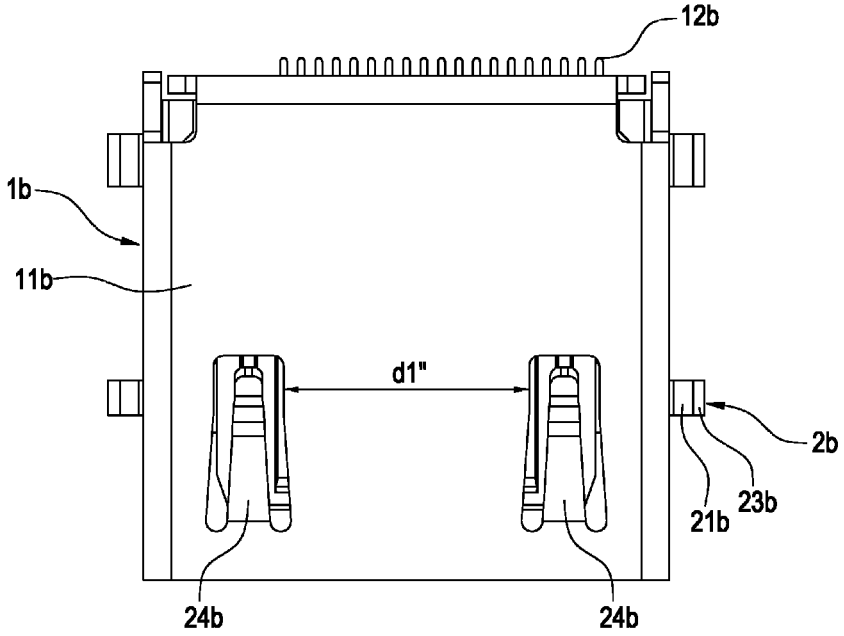
FIG. 17 is a top schematic view of the HDMI connector according to the third embodiment of the present invention.
Figure 18:
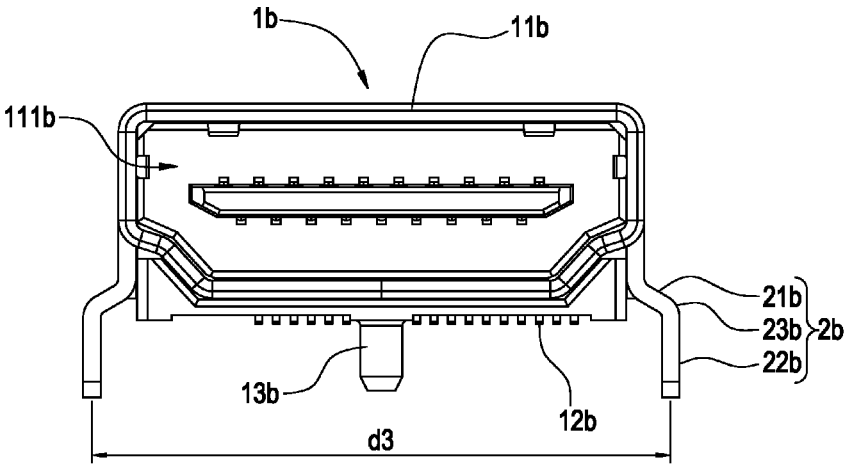
FIG. 18 is a front schematic view of the HDMI connector according to the third embodiment of the present invention.
Figure 19:
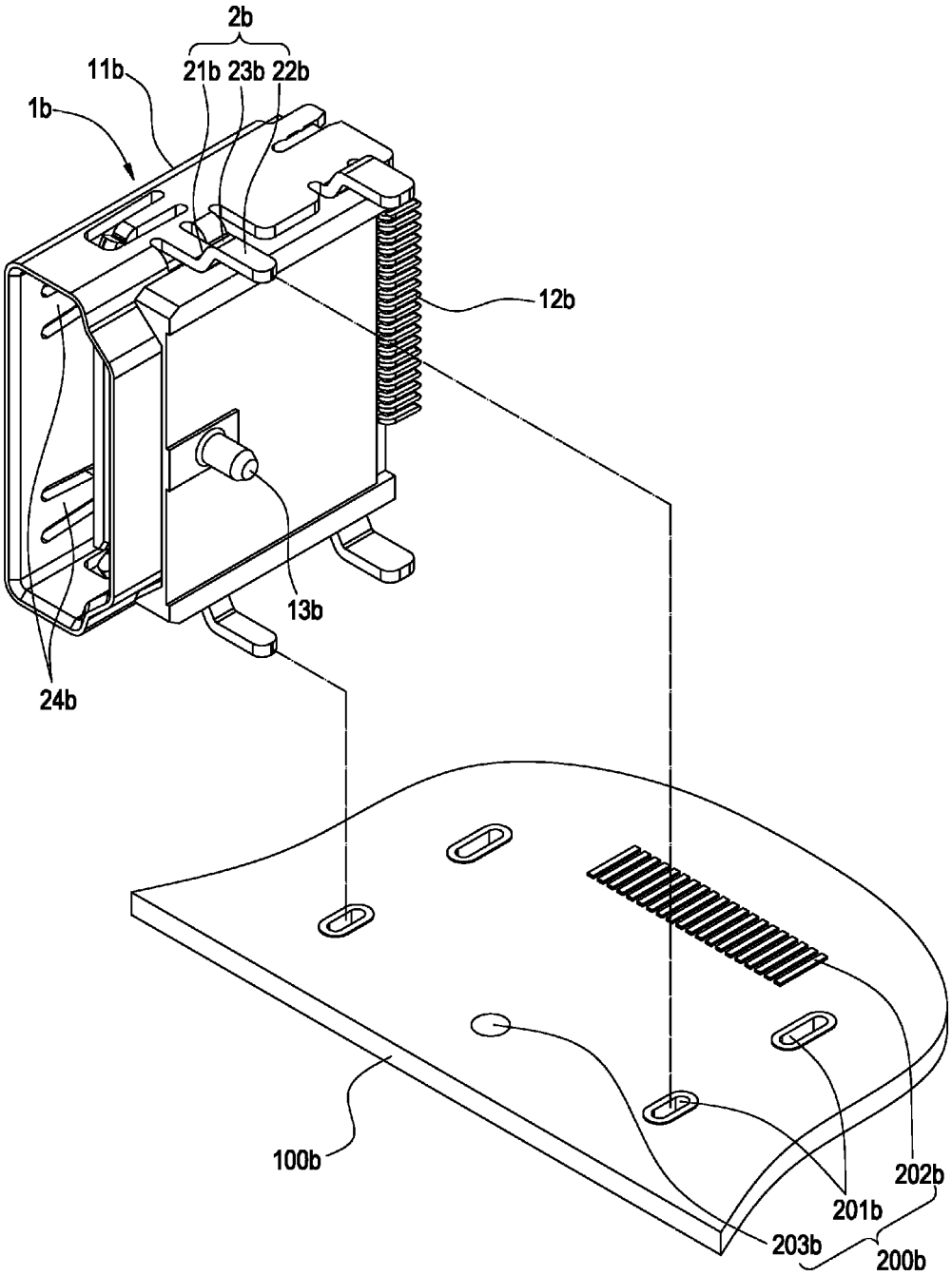
FIG. 19 is a schematic view of the HDMI connector according to the third embodiment of the present invention in an operational state.
Figure 20:
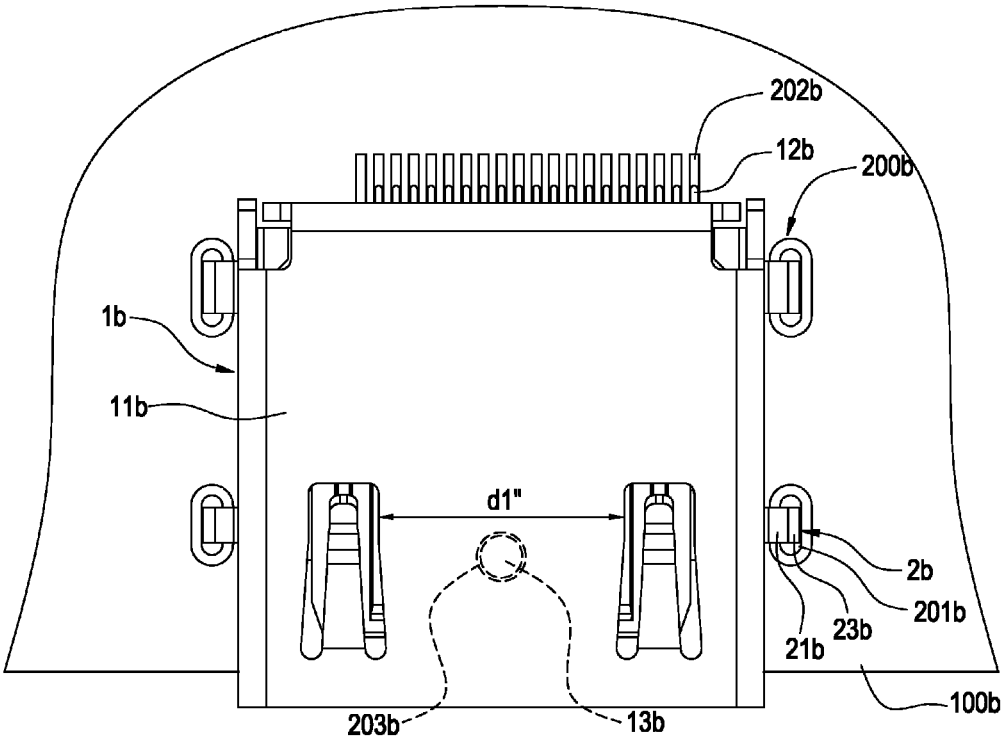
FIG. 20 is a schematic view of the HDMI connector according to the third embodiment of the present invention in another operational state.
Figure 21:
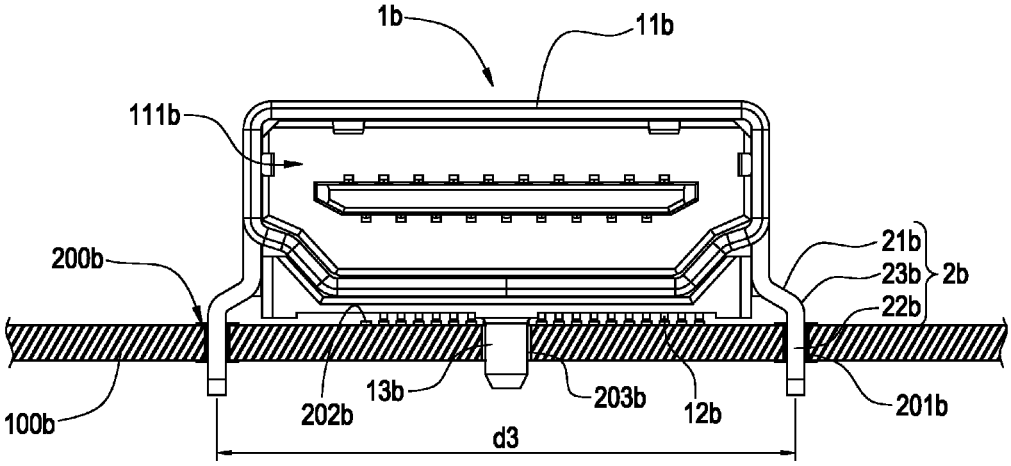
FIG. 21 is a schematic view of the HDMI connector according to the third embodiment of the present invention in yet another operational state.

Please refer to FIGS. 15-21 which relate to an HDMI connector according to the third embodiment of the present invention. This HDMI connector mainly comprises an HDMI socket 1*b* and a pair of positioning legs 2*b*.

The HDMI socket 1*b* has a shielding frame 11*b* which is hollow frame body. The HDMI socket 1*b* forms an inserting opening 111*b* corresponding to the shielding frame 11*b*. Besides, the HDMI socket 1*b* has 19 electrically conductive terminals 12*b* exposed to the shielding frame 11*b* and disposed in parallel, in which the 19 electrically conductive terminals 12*b* are opposite to the inserting opening 111*b* at the front end of the shielding frame 11*b* and disposed on the rear right of the shielding frame 11*b*. Moreover, the HDMI socket 1*b* has a vertical fixing post 13*b* exposed to the shielding frame 11*b*. In addition, two elastic pieces 24*b* are formed on the surface of the shielding frame 11*b* far away from the positioning legs 2*b*, in which the distance d1" between the two elastic pieces 24*b* is greater than 7.5 mm.

The pair of positioning legs 2*b* are connected to the HDMI socket 1*b*, respectively, and exposed on both sides of the shielding frame 11*b*. The distance d3 between the pair of positioning legs 2*b* ranges from 16.1 mm to 17.9 mm.

The detailed description is given below. The pair of positioning legs 2*b* are extending from the shielding frame 11*b*, respectively, and formed. There are two pairs of positioning legs 2*b* in the third embodiment. The two pairs of positioning legs 2*b* are disposed at the front end and the rear end of the shielding frame 11*b*, respectively. Each pair of the positioning legs 2*b* are extending from the left side and the right side of the shielding frame 11*b*, respectively, and formed. Also, each positioning leg 2*b* has an extending segment 21*b* and a connecting segment 22*b*; a bending segment 23*b* is disposed between the extending segment 21*b* and the connecting segment 22*b*. Two pairs of connecting segments 22*b* are insertedly disposed in the corresponding positioning holes 201*b*. The distance d3 is formed between the two connecting segments 22*b* of each pair.

The assembling of the HDMI connector of the present invention is performed using the HDMI socket 1*b* having the shielding frame 11*b*, and at least one pair of positioning legs 2*b* connected to the HDMI socket 1*b*, respectively, and exposed on both sides of the shielding frame 11*b*, in which the distance d3 between the two positioning legs 2*b* ranges from 16.1 mm to 17.9 mm.

As for the operation of the HDMI connector of the present invention, the HDMI connector of the present invention is used in a PCB 100*b* having a Display Port connection 200*b*. The PCB 100*b* deals with the transmissions of Display Port and HDMI via the Display Port connection 200*b* and other chips electrically connected thereto. The Display Port connection 200*b* includes two pairs of positioning holes 201*b*, 20 electrically conductive portions 202*b*, and an auxiliary fixing hole 203*b*.

The HDMI socket 1*b* is connected to at least one pair of positioning legs 2*b*. The distance d3 between the two positioning legs 2*b* of each pair ranges from 16.1 mm to 17.9 mm, which complies with the Display Port specification; thus, the two pairs of positioning legs 2*b* can be correspondingly inserted into the positioning holes 201*b*. Besides, the 19 electrically conductive terminals 12*b* of the HDMI socket 1*b* are also correspondingly electrically connected to 19 of the 20 electrically conductive portions 202*b*. Further, the vertical fixing post 13*b* of the HDMI socket 1*b* is correspondingly inserted into the auxiliary fixing hole 203*b* and secured.

To conform to the PCB 100*b* having a Display Port connection 200*b*, the HDMI socket 1*b* of the present invention has positioning legs 2*b* complied with the Display Port specification; that is, the distance d3 between the two positioning legs 2*b* of each pair ranges from 16.1 mm to 17.9 mm, further allowing the HDMI socket 1*b* to be insertedly disposed on the PCB 100*b* having the Display Port connection 200*b*. In addition, the PCB 100*b* can deal with the HDMI transmission via the Display Port connection 200*b* and other chips electrically connected thereto, enhancing convenience and diversity of motherboard assembling.

Moreover, the 19 electrically conductive terminals 12, 12*a*, and 12*b* and the vertical fixing post 13, 13*a*, and 13*b* of the HDMI socket 1, 1*a*, and 1*b* can be correspondingly connected to the Display Port connection 200, 200*a*, and 200*b*, further increasing the stability of the inserting connection between the HDMI socket 1, 1*a*, and 1*b* and the Display Port connection 200, 200*a*, and 200*b* and then enhancing the stability of the transmission between the HDMI connector of the present invention and the PCB 100, 100*a*, and 100*b*.

Also, two elastic pieces 24, 24*a*, and 24*b* are formed on the surface of the shielding frame 11, 11*a*, and 11*b* and the distance d1, d1', and d1" between the corresponding two elastic pieces 24, 24*a*, and 24*b* is greater than 7.5 mm, which allows a magnetic chuck to suck the HDMI connector between the corresponding two elastic pieces 24, 24*a*, and 24*b* during its machining and facilitates the following processes.

In summary, the HDMI connector of the present invention indeed achieves the expected objective and overcome the disadvantages of related art. Therefore, the present invention is useful, novel and non-obvious. Please examine the application carefully and grant it a patent for protecting the rights of the inventor.

What is claimed is:

1. A high definition multimedia interface (HDMI) connector, comprising:

a HDMI socket (1) having a shielding frame (11), the shielding frame (11) having a top surface, a bottom surface, and opposite side surfaces;

a vertical fixing post (13) is exposed to the bottom surface of the shielding frame (11); and two pairs of positioning legs (2) connected to the HDMI socket (1) and each of the two pairs of positioning legs (2) exposed on the opposite side surfaces of the shielding frame (11), respectively, wherein a distance between two positioning legs (2) on the same side of the shielding frame (11) ranges from 6.3 mm to 8.3 mm, wherein the two pairs of positioning legs (2) are complied with a Display Port specification such that the HDMI socket (1) is capable of being disposed on a printed circuit board (100) having a Display Port connection (200).

2. The HDMI connector according to claim 1, wherein each of the positioning legs (2) has an extending segment (21) and a connecting segment (22), wherein a bending segment (23) is disposed between the extending segment (21) and the connecting segment (22), wherein the distance is formed between two connecting segments (22) on the same side of the shielding frame (11).

3. The HDMI connector according to claim 1, wherein the two pairs of positioning legs (2) are formed by extending from the shielding frame (11), wherein the two pairs of positioning legs (2) are disposed at the front end and the rear end of the shielding frame (11), respectively, wherein the two pairs of the positioning legs (2) are formed by extending from the left side and the right side of the shielding frame (11), respectively.

4. The HDMI connector according to claim 1, wherein two elastic pieces (24) are formed on the top surface of the shielding frame (11) far away from the two pairs of the positioning legs (2), wherein a distance between the two elastic pieces (24) is greater than 7.5 mm.

5. The HDMI connector according to claim 1, wherein the HDMI socket (1) is formed with an inserting opening (111) corresponding to the shielding frame (11), wherein the HDMI socket (1) has nineteen electrically conductive terminals (12) exposed to the shielding frame (11) and disposed in parallel, wherein the nineteen electrically conductive terminals (12) are opposite to the inserting opening (111) at the front end of the shielding frame (11) and disposed on the rear right of the shielding frame (11).

6. A high definition multimedia interface (HDMI) connector, comprising:

a HDMI socket (1*a*) having a shielding frame (11*a*), the shielding frame (11*a*) having a top surface, a bottom surface, and opposite side surfaces;

a vertical fixing post (13*a*) is exposed to the bottom surface of the shielding frame (11*a*); and two positioning legs (2*a*) connected to the HDMI socket (1*a*), and exposed on the opposite side surfaces of the shielding frame (11*a*), respectively, wherein the two positioning legs (2*a*) are disposed asymmetrically and a shift distance (s) formed in between the two positioning legs (2*a*) is at least greater than 0.1 mm, wherein the two pairs of positioning legs (2) are complied with a Display Port specification such that the HDMI socket (1) is capable of being disposed on a printed circuit board (100) having a Display Port connection (200).

7. The HDMI connector according to claim 6, wherein each of the two positioning legs (2*a*) has an extending segment (21*a*) and a connecting segment (22*a*), wherein a bending segment (23*a*) is disposed between the extending segment (21*a*) and the connecting segment (22*a*), wherein the shift distance (s) is formed between two connecting segments (22*a*).

8. The HDMI connector according to claim 6, further comprising two auxiliary positioning legs (2*a*'), wherein the two positioning legs (2*a*) are formed by extending from the shielding frame (11*a*), wherein the two positioning legs (2*a*) are disposed at the front end of the shielding frame (11*a*) and the two auxiliary positioning legs (2*a*') are disposed at the rear end of the shielding frame (11*a*), wherein the two positioning legs (2*a*) and the two auxiliary positioning legs (2*a*') are formed by extending from the left side and the right side of the shielding frame (11), respectively.

9. The HDMI connector according to claim 8, wherein the two positioning legs (2*a*) and the two auxiliary positioning legs (2*a*') are complied with the Display Port specification.

10. The HDMI connector according to claim 6, wherein two elastic pieces (24*a*) are formed on the top surface of the shielding frame (11*a*) far away from the two positioning legs (2*a*), wherein a distance between the two elastic pieces (24*a*) is greater than 7.5 mm.

11. The HDMI connector according to claim 6, wherein the HDMI socket (1*a*) is formed with an inserting opening (111*a*) corresponding to the shielding frame (11*a*), wherein the HDMI socket (1*a*) has nineteen electrically conductive terminals (12*a*) exposed to the shielding frame (2*a*) and disposed in parallel, wherein the nineteen electrically conductive terminals (12*a*) are opposite to the inserting opening (111*a*) at the front end of the shielding frame (11*a*) and disposed on the rear right of the shielding frame (11*a*).

12. A high definition multimedia interface (HDMI) connector, comprising:

a HDMI socket (1*b*) having a shielding frame (11*b*), the shielding frame (11*b*) having a top surface, a bottom surface, and two opposite side surfaces;

a vertical fixing post (13*b*) is exposed to the bottom surface of the shielding frame (11*b*); and at least one pair of positioning legs (2*b*) connected to the HDMI socket (1*b*) and each of the at least one pair of positioning legs (2*b*) exposed on one side of the shielding frame (11*b*), wherein a distance between two legs of the at least one pair of positioning legs (2*b*) ranges from 16.1 mm to 17.9 mm, wherein the two pairs of positioning legs (2) are complied with a Display Port specification such that the HDMI socket (1) is capable of being disposed on a printed circuit board (100) having a Display Port connection (200).

13. The HDMI connector according to claim 12, wherein each leg of the at least one pair of positioning legs (2*b*) has an extending segment (21*b*) and a connecting segment (22*b*), wherein a bending segment (23*b*) is disposed between the extending segment (21*b*) and the connecting segment (22*b*), wherein the distance is formed between two connecting segments (22).

14. The HDMI connector according to claim 12, wherein the at least one pair of positioning legs (2*b*) is formed by extending from the shielding frame (11*b*).

15. The HDMI connector according to claim 14, wherein two pairs of positioning legs (2*b*) are provided, wherein the two pairs of positioning legs (2*b*) are disposed at the front end and the rear end of the shielding frame (11*b*), respectively, wherein two pairs of the positioning legs (2*b*) are formed by extending from the left side and the right side of the shielding frame (11*b*), respectively.

16. The HDMI connector according to claim 12, wherein two elastic pieces (24*b*) are formed on the top surface of the shielding frame (11*b*) far away from the positioning legs (2*b*), wherein a distance between the two elastic pieces (24*b*) is greater than 7.5 mm.

17. The HDMI connector according to claim 12, wherein the HDMI socket (1*b*) is formed with an inserting opening (111*b*) corresponding to the shielding frame (11*b*), wherein the HDMI socket (1*b*) has nineteen electrically conductive terminals (12*b*) exposed to the shielding frame (2*b*) and disposed in parallel, wherein the nineteen electrically conductive terminals (12*b*) are opposite to the inserting opening (111*b*) at the front end of the shielding frame (11*b*) and disposed on the rear right of the shielding frame (11*b*).

* * * * *